United States Patent [19]

Fan

[11] Patent Number: 5,041,951

[45] Date of Patent: Aug. 20, 1991

[54] MULTIPURPOSE TRUNCHEON FOR BODY PROTECTION

[75] Inventor: Chin-Ming Fan, Taipei, Taiwan

[73] Assignee: Fortress Pacific Corporation, Taipei, Taiwan

[21] Appl. No.: 560,208

[22] Filed: Jul. 31, 1990

[51] Int. Cl.[5] ..... A45B 3/02; F21V 33/00

[52] U.S. Cl. ..... 362/102; 362/109; 362/190; 273/84 R; 273/84 ES

[58] Field of Search ..... 362/102, 109, 111, 112, 362/191, 190; 273/84 R, 84 ES

[56] References Cited

U.S. PATENT DOCUMENTS

| | | | |
|---|---|---|---|
| 2,908,901 | 10/1959 | Lewis | 362/102 X |
| 4,283,051 | 8/1981 | Perez | 273/84 R |
| 4,486,807 | 12/1984 | Yanez | 273/84 ES |
| 4,687,131 | 8/1987 | von Braunhut | 273/84 R |
| 4,703,402 | 10/1987 | Hsieh | 362/102 |
| 4,819,137 | 4/1989 | Hamilton | 362/102 |

*Primary Examiner*—Ira S. Lazarus
*Assistant Examiner*—Peggy Neils
*Attorney, Agent, or Firm*—Fleit, Jacobson, Cohn, Price, Holman & Stern

[57] ABSTRACT

A truncheon for body protection in the form of a hollow, telescopic stick made of transparent or red color PC material with electric discharging elements peripherally attached thereto and respectively connected to a battery and a transformer which are received inside a finger guard made on the hand-hold of the stick. A gas tank is fastened inside a rigid cap at the back of the hollow stick and controlled by a switch to eject gas through a gas nozzle at the front end of the stick. A lamp holder bent at 90 degrees is attached to the hand-hold of the stick for holding a flash lamp which is connected to the battery and controlled by a switch to produce high intensity of flashing light. A clear, shrill sound is made while gas is ejected from the gas tank through the gas nozzle via a whistle valve.

1 Claim, 2 Drawing Sheets

MULTIPURPOSE TRUNCHEON FOR BODY PROTECTION

BACKGROUND OF THE INVENTION

1. Field of the Invention

The present invention relates to a design of multipurpose truncheon which can be controlled to produce warning light and discharge electricity for body protection and can also be used as bar for fighting or a baton for directing the flow of motor vehicles.

2. Description of the Prior Art

A truncheon for body protection according to the prior art is generally formed of a telescopic stick which discharges electricity to cause electric shock when it is used to hit somebody. This type of truncheon is designed for defending oneself against burglars or for directly attacking burglars. It does not produce warning signal as a deterrent to burglars.

SUMMARY OF THE INVENTION

The present invention is to provide a truncheon for body protection, which can also be used as a baton for directing the flow of motor vehicles. A body protection truncheon according to the present invention is generally comprised of a hollow, telescopic stick made of transparent or red color PC material with electric discharging elements peripherally attached thereto and respectively connected to a battery and a transformer which are received inside a finger guard made on the hand-hold of the stick. A gas tank is fastened inside a rigid cap at the back of the hollow stick and controlled by a switch to eject gas through a gas nozzle at the front end of the stick. A lamp holder bent at 90 degrees is attached to the hand-hold of the stick for holding a flash lamp which is connected to the battery, covered with a transparent or red cover and controlled by a switch to produce high intensity of flashing light. A clear, shrill sound is made while gas is ejected from the gas tank through the gas nozzle via a whistle valve.

BRIEF DESCRIPTION OF THE DRAWINGS

The present invention will now be described by way of example with reference to the annexed drawings, in which.

DETAILED DESCRIPTION OF THE PREFERRED EMBODIMENT

Figure 1:
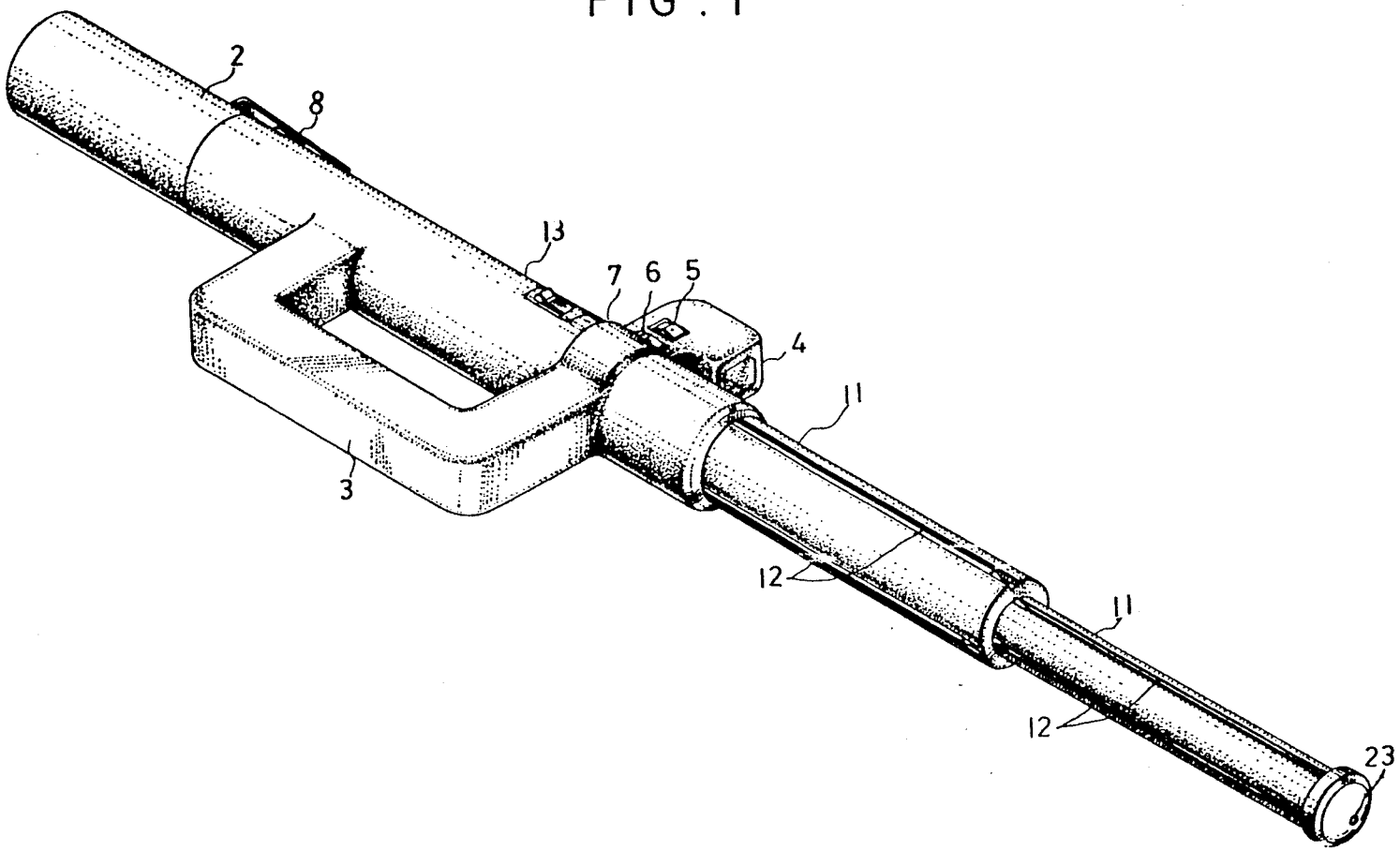
FIG. 1 is a perspective assembly view of the preferred embodiment of the present invention.
Figure 2:
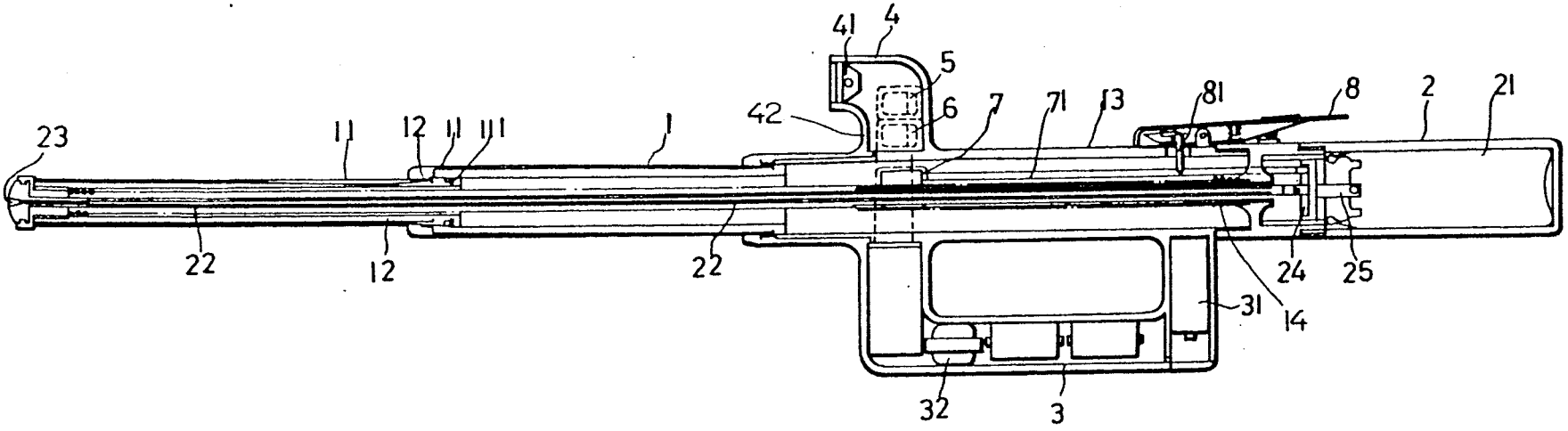
FIG. 2 is a longitudinally sectional assembly view thereof.

Referring to FIGS. 1 and 2 a truncheon 1 of the present invention is generally comprised of a telescopic, electric discharging stick 11 made of PC material in transparency or red color and having a plurality of lines of electric discharging elements 12 longitudinally externally attached thereto. The telescopic, electric discharging stick 11 is attached with a rigid cap 2 at the bottom with a gas tank 21 set therein. An expansible inner tube 22 is received inside the telescopic, electric discharging stick 11 and connected between the gas tank 21 and a gas nozzle 23 which is fastened at the front end of the telescopic electric discharging stick 11. The expansible inner tube 22 may be made of rubber material or other suitable material which has a high flexibility such that it follows the telescopic electric discharging stick 11 to expand or contract. An unitary U-shaped finger guard 3 is made on the hand-hold portion 13 of the telescopic, electric discharging stick 11 at one side for holding battery 31 and transformer 32. A lamp holder 4 which is bent at 90 degrees for holding a flash lamp 41 is attached to the telescopic, electric discharging stick 11 at the front end of the hand-hold portion 13 opposite to the finger guard 3. The telescopic, electric discharging stick 11 also comprises at the front end of the hand-hold portion 13 at suitable locations convenient for touching of fingers a first control switch 5 for electric discharge and flashing light control, a second control switch 6 for flashing light control, a third control switch 7 for gas ejection control. There is a fourth control switch 8 attached to the rear end of the hand-hold portion 13 near the rigid cap 2 for ballistic control to let the telescopic, electric discharging stick 11 project suddenly.

As described above, a truncheon 1 according to the present invention is most preferably made of PC material which is rigid and suitable for hitting. It can be made in transparency or red color so that it can be used as a baton for directing the flow of motor vehicles.

Referring to FIG. 2 again, there is a compression spring 14 of high strength set inside the truncheon 1. When the telescopic, electric discharging stick 11 is squeezed inward to compress the compression spring 14 to the limit, a latch 81 which is controlled by the fourth control switch 8 automatically inserts in the slot 111, which is made on the first front sliding part of the telescopic, electric discharging stick 11, to secure the telescopic, electric discharging stick 11 in a contracted condition. When the fourth control switch 8 is pressed down at its rear end, the latch 81 is disengaged from the slot 111 permitting the compression spring 14 to suddenly push the telescopic, electric discharging stick 11 to project to its maximum extent.

As described above, there is an expansible inner tube 22 received inside the telescopic, electric discharging stick 11 and connected between the gas tank 21 and the gas nozzle 23. When the third control switch 7 is pulled backward, a plate spring 71 is simultaneously driven to press on a whistle valve 24 permitting a tube 25, which is fastened in the whistle valve 24 at the back, to insert in the gas tank 21 so that gas is permitted to pass through the whistle valve 24 and the expansible inner tube 22 for ejection out of the telescopic, electric discharging stick 11 through the gas nozzle 23. While passing of gas through the whistle valve 24, a clear, shrill sound is simultaneously made. Whenever the telescopic, electric discharging stick 11 is in an extended or contracted condition, gas is permitted to eject upon the control of the third control switch 7.

The flash lamp 41 and the electric discharging elements 12 are respectively controlled by the second and first control switches 6, 5. Voltage from the battery 31 through the transformer 32 is connected to the electric discharging elements 12 and the flash lamp 41. Once the second control switch 6 is pressed on, the flash lamp 41 immediately produces high intensity of flashing light (the covering of the lamp holder 4 can be transparent or of red color) to irritate offender's eyes. When the first control switch 5 is pressed on, the flash lamp 41 is turned on to produce high intensity of flashing light and the electric discharging elements 12 on the telescopic, electric discharging stick 11 are simultaneously turned on to discharge high voltage and electric spark (as high as 45000 V) to frighten offenders away.

Referring to the annexed drawings again, the U-shaped finger guard 3 of the hand-hold portion, the 90 degree bend of lamp holder 4 and the rigid cap 2 are also provided for some special functions. The U-shaped finger guard 3 can protect one's fingers and the lamp holder 4 can protect one's thumb while fighting against offenders. The jaw 42 between the lamp holder 4 and the telescopic, electric discharging stick 11 can be used to retain offender's weapon during fighting. The rigid cap 2 at the rear end of the hand-hold portion 13 can be used for hitting offenders.

What is claimed is:

1. A body protection truncheon, comprising:

a hand-hold having a rigid cap fastened thereto at one end;

a hollow stick made of PC material, being fastened inside said hand-hold opposite to said rigid cap and having a gas nozzle fastened at the front end, said hollow stick being comprised of a plurality of sections that slide one inside another, said sections having each a plurality of lines of electric discharging elements externally fastened therein;

a gas tank fastened inside said rigid cap for containing gas, having a whistle valve for gas ejection control and for making a clear, shrill sound during ejection of gas therethrough;

an expansible inner tube connected between said whistle valve of said gas tank and said gas nozzle;

an U-shaped finger guard made on said hand-hold at one side for holding a battery and a transformer therein;

a lamp holder attached to said hand-hold at the front end opposite to said U-shaped finger guard for holding a flash lamp, said lamp holder being bent at 90 degrees, said flash lamp being covered with a cover;

a first control switch made on said hand-hold near said lamp holder for controlling said battery and said transformer to provide voltage to said flash lamp for producing flashing light and to said electric discharging elements for discharging high voltage and electric spark;

a second control switch made on said hand-hold near said first control switch for controlling said battery to turn on said flash lamp to produce high intensity of flashing light;

a third control switch made on said hand-hold near said second control switch for controlling a plate spring to press on said whistle valve permitting the gas inside said gas tank to pass through said whistle valve and said expansible inner tube for ejection out of said hollow stick through said gas nozzle; and a fourth control switch attached to said hand-hold and said rigid cap for controlling a latch to alternative retain said hollow stick during its contracted condition or release a spring to push said hollow stick to extend to its maximum extent.

* * * * *